US009489003B1

(12) United States Patent
O Sullivan et al.

(10) Patent No.: US 9,489,003 B1
(45) Date of Patent: Nov. 8, 2016

(54) ACTIVE PHASE BALANCING IN POWER ZONES

(71) Applicant: Google Inc., Mountain View, CA (US)

(72) Inventors: Cornelius B. O Sullivan, Mountain View, CA (US); Philippe H. Gow, Sunnyvale, CA (US); Mark R. Imbertson, Pleasanton, CA (US)

(73) Assignee: Google Inc., Mountain View, CA (US)

( * ) Notice: Subject to any disclaimer, the term of this patent is extended or adjusted under 35 U.S.C. 154(b) by 525 days.

(21) Appl. No.: 14/053,203

(22) Filed: Oct. 14, 2013

(51) Int. Cl.
*G05F 1/66* (2006.01)

(52) U.S. Cl.
CPC ..... *G05F 1/66* (2013.01)

(58) Field of Classification Search
CPC ..... G05F 1/66; G05F 1/455; G06F 19/00; H02J 1/08; H02J 3/26
USPC ..... 307/13, 14; 702/65
See application file for complete search history.

(56) References Cited

U.S. PATENT DOCUMENTS

| | | | | |
|---|---|---|---|---|
| 4,143,414 | A | 3/1979 | Brewster et al. | |
| 4,680,689 | A | 7/1987 | Payne et al. | |
| 5,003,453 | A | 3/1991 | Tighe et al. | |
| 7,096,372 | B2 | 8/2006 | Sone | |
| 8,270,188 | B1 | 9/2012 | Kim | |
| 8,385,096 | B2 | 2/2013 | Yuzurihara et al. | |
| 2007/0046103 | A1* | 3/2007 | Belady | H02G 3/00 307/12 |
| 2011/0302440 | A1 | 12/2011 | DiMarco et al. | |
| 2012/0316691 | A1 | 12/2012 | Boardman et al. | |
| 2013/0163297 | A1* | 6/2013 | Phadke | H02J 3/26 363/65 |

FOREIGN PATENT DOCUMENTS

| | | |
|---|---|---|
| EP | 502096 B1 | 9/1995 |
| EP | 595091 B1 | 5/1998 |

OTHER PUBLICATIONS

U.S. Appl. No. 13/420,268, filed Mar. 14, 2012, Line Balancing for a Three-Phase Alternating Current System, Sangsun Kim et al.
U.S. Appl. No. 13/299,350, filed Nov. 17, 2011, Circuitry and Methodology for Three-Phase Power Factor Correction, Sangsun Kim et al.
U.S. Appl. No. 13/651,770, filed Oct. 15, 2012, Active Phase Balancing at Facility Level, Richard Stuart Roy et al.
U.S. Appl. No. 14/145,713, filed Dec. 31, 2013, Three-Phase Power Supply System, Sangsun Kim et al.
(Continued)

*Primary Examiner* — Jeffrey Shin
(74) *Attorney, Agent, or Firm* — Fish & Richardson P.C.

(57) ABSTRACT

Methods, systems, and apparatus for managing power in a data center. In one aspect, a method includes monitoring respective phase power level in each phase of an alternating current multi-phase supply that provides power to a plurality of data center alternating current devices in a data center, comparing the respective phase power levels to phase distribution criteria that describe a target phase power level for each respective phase and determine, based on the comparison, a deviation of one or more of monitored phase power levels from the respective one or more target phase power levels and in response generate, for each of two or more data center alternating current devices, respective control signals to adjust the one or more adjustable phase power supplies in the data center alternating current device according to a determined adjustment for the data center alternating current device.

14 Claims, 3 Drawing Sheets

(56) References Cited

OTHER PUBLICATIONS

Chunkag and Kamnarn "Parallelling three-phase AC to DC converter using CUK rectifier modules based on power balance control technique" IET Power Electronics 2010, vol. 3(4), pp. 511-524 (www.ietdl.org).

Pan and Liao "Modeling and Control of Circulating Currents for Parallel Three-Phase Boost Rectifiers With Different Load Sharing" IEEE Transactions of Industrial Electronics vol. 55(7), Jul. 2008, 2776-2785.

Mammano et al., Load Sharing with Paralleled Power Supplies, Texas Instruments Incorporated, 2001, Sep. 1991, 16 pages.

* cited by examiner

ACTIVE PHASE BALANCING IN POWER ZONES

TECHNICAL FIELD

This document relates to facilities power management.

BACKGROUND

Data center facilities are often used by providers to deliver Internet services to users. A data center, such as a server farm, typically contains thousands of server processing devices. Within the data centers the processing devices are arranged in racks, and each rack may contain dozens of servers. Assuming the power required for a single rack may be in the order of 50 kW, and that there may be hundreds of racks in a data center, it is not uncommon for a data center to have a power requirement on the order of megawatts.

A data center typically receives three-phase power from a utility provider. The three-phase power is provided to each rack, and each rack includes AC to DC converters to convert the AC input to DC output. An example rack receives three-phase power and includes a rectifier for each phase that converts the single phase input to a DC output. The DC output of each rectifier is then coupled to a common DC power bus in the rack that is used to provide power to the DC server components.

In a three-phase system, it is desirable to balance the load on each phase. In general, a perfectly balanced load on the three-phase supply will result in no neutral current. In practice, however, there are always slight imbalances when a load is distributed evenly across the phases. In a data center, for example, such imbalances may arise when servers go down and thus do not require power; when AC to DC converter characteristics drift due to temperature variances or manufacturing variances; and when the phase voltages provided by the utility provider sag. Such imbalances, if sufficiently large, may lead to nuisance breaker trips, power capping, and over/under voltage/current conditions.

SUMMARY

In general, one innovative aspect of the subject matter described in this specification can be embodied in methods that include the actions of monitoring, in a data center, a respective phase power level in each phase of an alternating current multi-phase supply that provides power to a plurality of data center alternating current devices, wherein: at least a proper subset of the alternating current devices include alternating current devices that each receive as input each phase of the multi-phase supply, and, for each phase, includes an adjustable phase power supply that converts a respective alternating current input to a direct current output and provides the direct current output to a direct current bus that is common to each direct current output for each respective adjustable phase power supply in the alternating current device, and each of the alternating current devices in the proper subset is operable to receive from the data processing apparatus control signals that define an adjustable power setting for the respective adjustable phase power supplies and in response adjust the adjustable phase power supplies to change the power level output by each adjustable phase power supply; comparing the respective phase power levels to phase distribution criteria that describe a target phase power level for each respective phase and determine, based on the comparison, a deviation of one or more of monitored phase power levels from the respective one or more target phase power levels and in response: determine, for each of two or more data center alternating current devices, an adjustment to one or more of the adjustable phase power supplies that adjusts the power level output by the adjustable phase power supply, wherein the combination of the adjustments of the power levels reduces the deviation of the one or more of monitored phase power levels from the respective one or more target phase power levels; generating, for each of the two or more data center alternating current devices, respective control signals to adjust the one or more adjustable phase power supplies in the data center alternating current device according to the determined adjustment for the data center alternating current device; and providing, to each of the two or more data center alternating current devices, the respective control signals to the alternating current device. Other embodiments of this aspect include corresponding systems, apparatus, and computer programs, configured to perform the actions of the methods, encoded on computer storage devices.

Particular embodiments of the subject matter described in this specification can be implemented so as to realize one or more of the following advantages. Dynamic phase balancing is coordinated among multiple racks in a power zone to take advantage of constituent phase imbalances that may occur at the rack level but that, in the aggregate, result in phase balancing at the power zone input. This enables flexibility to account for racks that cannot be phase balanced individually. By measuring the power consumed on each phase at a power zone level, coordinate adjustments are made to the individual rectifiers at the rack level so that phase balancing is achieved, which, in turn, optimally utilizes facility provisioned power. Furthermore, phase imbalances induced by addition of non-adjustable three-phase load types (e.g., fans, chillers, etc.) to affected power domain single phases or in unbalanced fashion across multiple phases can be counteracted by the methods outlined herein, thus allowing more full utilization of the power infrastructure.

The details of one or more embodiments of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

The systems and methods in this written description are described in the context of three-phase computer racks with adjustable phase power supplies. However, the features described below can be implemented with any multi-phase loads that have adjustable phase supplies for each load. Thus, the features described below are not limited to applications within data centers, and can be implemented in any facility that utilizes multi-phase power.

Figure 1:
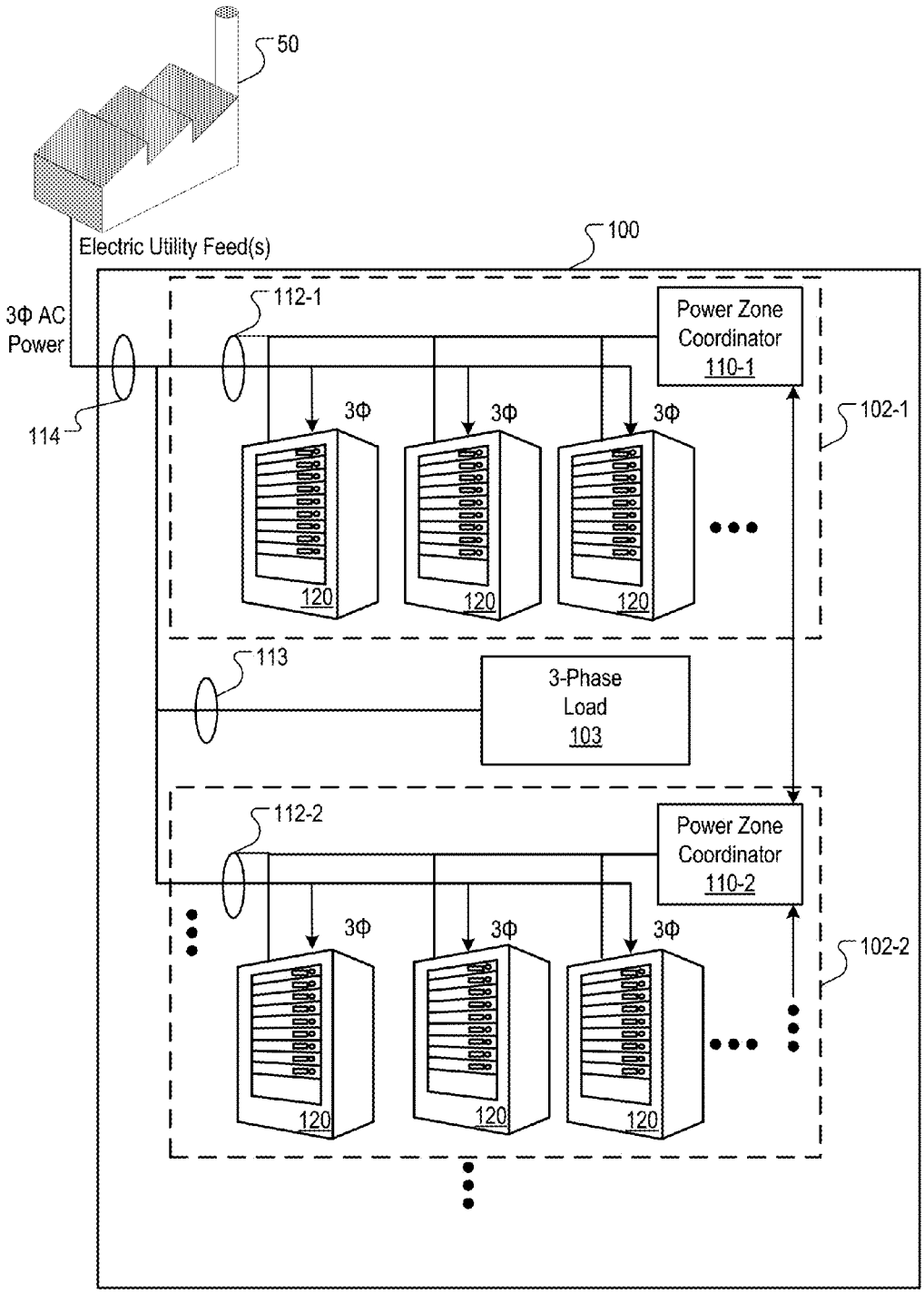
FIG. 1 is an illustration of a power zone topology in a data center facility.

FIG. 1 is an illustration of a power zone topology in a data center facility 100. The facility 100 can occupy one or more rooms within a building or essentially an entire building. The facility 100 is sufficiently large for installation of numerous (e.g., dozens or hundreds or thousands) alternating current devices, such as racks 120 of computer equipment, and other loads that collective constitute a three-phase load 103. As will be described below, the some of the alternating current devices have adjustable power supplies for each phase, such as the racks 120, while others do not. Examples of the latter include motors, chillers, AC lighting, etc. Thus, in some implementations, only a proper subset of the alternating current devices have adjustable power supplies for each phase.

The racks 120 of mounted computers are arranged in rows and are separated by aisles. Each rack 120 includes multiple processing devices. In general, each processing device includes a motherboard, on which a variety of computer-related components are mounted. The facility 100 includes other computer and routing devices (not shown) to connect the facility to a network, such as the Internet.

The facility 100 is also connected to a three phase power supply from a utility provider 50 to power the racks 120. Although one three phase feed is shown, the features described below can also be applied to situations in with two or more multi-phase feeds are used to provide power to a facility.

In operation, power distribution to the racks 120 is managed by power zones 102, and each power zone is managed by a power zone coordinator 110. The power zone coordinator 110 can be implemented in a data processing apparatus, such as a computer that is configured to receive data from various monitoring devices, such as phase meters, and data reporting rack status. In response to the received data, the power zone coordinator 110 provides control signals to each rack 120 to control power consumption on each phase in each rack 120 within its zone. Although one power zone coordinator 110 is shown for each zone 102, in some implementations a single power zone coordinator 110 can manage multiple zones 102.

As each rack 120 may house, for example, up to 100 processing devices, each rack 120 may individually consume on the order of 50 kW of power. Given the hundreds of racks within the data center, power distribution is managed, in some implementations, according to the power zones 102. The power zone coordinator 110 monitors the phase power levels in each phase as indicated by phase meters 112.

As will be explained in more detail below, the power zone coordinator 110 adjusts the power levels in each phase for each rack 120 to achieve, or at least reduce, the overall deviation of monitored phase power levels for the power zone input from a target phase power level for each phase. Usually the target phase power levels constitute a balanced load across all phases. However, a different target power level can also be used, depending on the needs of the facility.

Furthermore, in some implementations, the power zone coordinators 110 can also receive phase power levels for the entire facility, as indicated by the phase meters 114, the phase power levels for the non-adjustable three-phase loads 103, as indicated by the phase meter 113, and the phase power levels for each other power zone 102. Using this data, the power zone coordinators 110 can determine a set of phase power levels for each zone 102 that collectively achieve target phase power levels for the entire facility. For example, assume there are only two power zones, 102-1 and 102-2, and the three-phase loads 103. Also assume that, due to rectifier failures and tolerances, the power zone 102-1 has a 3% undercurrent condition on phase A (i.e., phase A is drawing 3% less current than target), and a 2% overcurrent condition on phase B (i.e., phase B is drawing 2% more current than target). Also assume that power zone 102-2 is phase balanced. Summing the phase currents for the two zones results in an overall phase imbalance for the facility.

To rectify this situation, the power zone controller 110-1 attempts to increase the current on phase A and decrease the current on phase B in power zone 102-1. However, due to temperatures, tolerances, and yields, power zone 102-1 can only be corrected to the point where it has a 1.5% undercurrent on phase A, and a 0.5% overcurrent on phase B. In response, power zone coordinator 110-2 can adjust the phase currents in power zone 102-2 so that the overall phase power levels seen at the facility input are balanced. Furthermore, and in a similar manner to the example above, should the three-phase loads 103 contribute to the imbalance, or cause some other deviation from a target load distribution, the phase distributions in zones 102-1 and 102-2 can be adjusted to achieve an overall phase balance.

Figure 2:
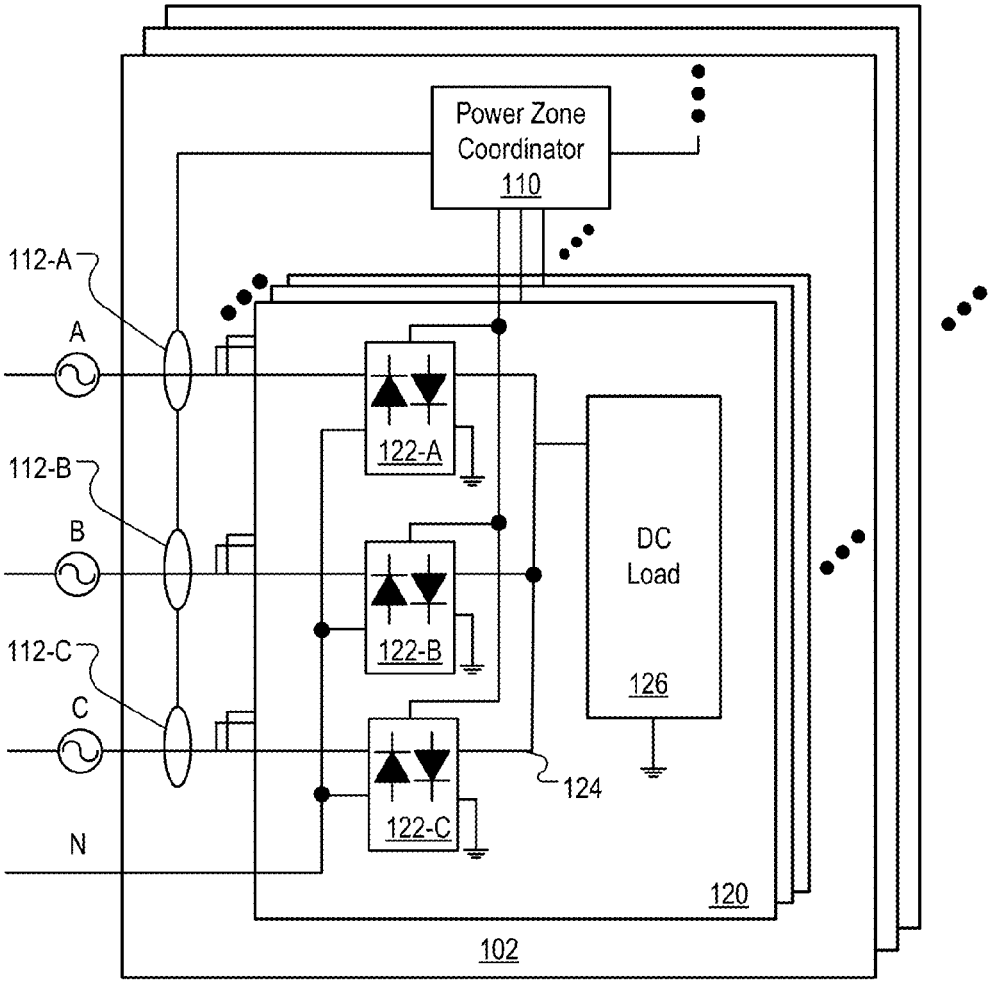
FIG. 2 is a block diagram of a power zone in a data center.

Managing of phase power levels in a power zone is described in more detail with reference to FIG. 2, is a block diagram of a power zone 102 in a data center. As illustrated in FIG. 2, a power zone 102 receives three-phase input power (Phases A, B and C) and each rack 120 in the power zone is connected to each of the three phases. Each AC phase is converted to DC power by an adjustable phase power supply 122. A variety of appropriate phase power supplies that convert AC to DC can be used. For example, phase rectifiers and power condition converters can be used.

The phase power supplies 122 are adjustable in that each may limit the amount of current that feeds into the supply 122, or limit the amount of voltage, or both. In this way the amount of power contributed by the phase to the rack 120 can be controlled. Each rack 120 receives from the power zone coordinator 110 control signals that define adjustable power settings for the respective adjustable phase power supplies 122. In response to these signals, each of the phase power supplies 122 can be adjusted to change the respective amount of power contributed to the DC bus 124, and, in turn, the current and/or voltage required at its input.

Each of the adjustable phase power supplies 122 converts the respective alternating current input to a direct current output and provides the direct current output to a direct current bus 124 that is common to each direct current output for each other respective adjustable phase power supply 122. A DC load 126, which represents the DC components of the computer devices operating within the rack 120, is powered off the DC bus 122.

In some implementations, each rack 120 can provide the adjustable power setting for each adjustable phase power supply 122 to the power zone controller. The setting describes the current capacity at which a phase power supply 122 is operating. For example, assume a phase power supply 122 is rated for 100 Amps, and can limit the current input from 100 Amps maximum down to 90 Amps minimum. A setting may indicate the phase power supply 122 is currently set to limit the input current to 97 Amps. The setting data may also, in some implementations, describe the actual value of the electrical feature being managed. For example, while the setting may indicate the current is limited to 97 Amps, the actual current being drawn on the rack 120 for that phase may be, e.g., 97.2 Amps. The deviation may be due to variations in tolerances, drift, etc.

The power zone coordinator 110 monitors the phase power levels on the AC input by the phase meters 112-A, 112-B and 112-C, and compares the respective phase power levels to phase distribution criteria that describe a target phase power level for each respective phase. For example, the phase distribution criteria may specify a balanced load at the input of the power zone 102. Alternatively, the phase distribution criteria may specify an imbalanced load at the input of the power zone 102, such as may be required when other power zones 102 cannot be balanced. In this latter situation, the power zone coordinator(s) 110 determine a set of phase imbalances for the power zones 102 such that the global sum of the phases for all of the power zones better approaches a balance (or some other target phase distribution).

When the comparison reveals there is a deviation of one or more of monitored phase power levels from the respective one or more target phase power levels, the power zone coordinator 110 determines, for each the racks 120 in its zone 102, an adjustment to one (or more) of the adjustable phase power supplies 122 that adjusts the power level output by the adjustable phase power supply 122. This adjustment results in a change in current drawn (or voltage step down at a rectifier input) by the supply 122. The combination of the adjustments of the power levels changes the phase power levels drawn at the rack 120 input, which, in turn, changes the phase power levels for the power zone 102. The adjustments are such that the deviation of the one or more of monitored phase power levels from the respective one or more target phase power levels is reduced. The power zone coordinator 110 generates, for example, respective control signals to adjust the adjustable phase power supplies 122 in the data center rack 120 according to the adjustment that the power zone coordinator 110 determines is necessary for the rack 120.

A variety of appropriate power distribution flow algorithms can be used to derive settings among each respective supply 122 in each respective rack 120 in a zone. For example, bus-injection to branch-current (BIBC) and branch-current to bus-voltage (BCVB) matrix models of the power zone 102 can be used. Other algorithms for solving multiple-input, multiple-output variable problems can also be used.

Figure 3:
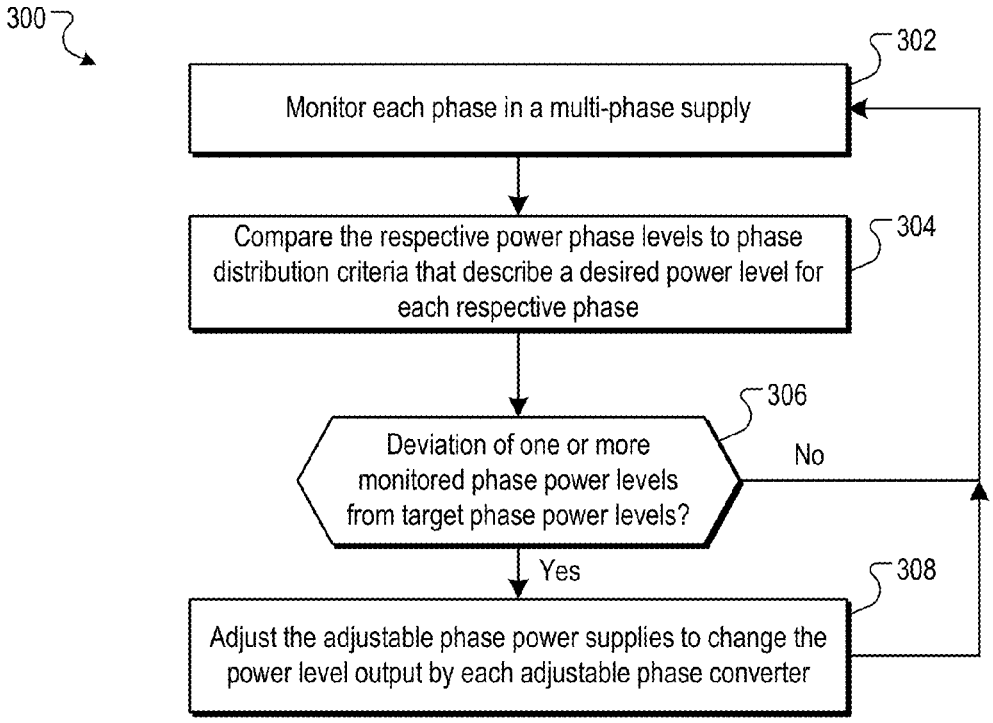
FIG. 3 is a flow diagram of an example process for dynamic phase adjustment for a data center facility.

Operation of the power zone coordinator 110 is described in more detail with reference to FIG. 3, which is a flow diagram of an example process 300 for dynamic phase adjustment for a data center facility. The process 300 is implemented, for example, in a data processing apparatus that is used to realize the power zone controller 110.

The process 300 monitors each phase in a multi-phase supply (302). For example, the power zone coordinator 110 monitors a respective phase power level in each phase of a three-phase AC supply that provides power to all racks 120 in the zone 102 controlled by the power zone coordinator 110.

The process 300 compares the respective power phase levels to phase distribution criteria that describe a target power level for each respective phase (304). For example, the distribution criteria may be defined, for each phase, in terms of a target phase voltage, a target current, and, optionally, other factors, such as a maximum power lag or lead. The power zone controller 110 receives data from the phase meters 112-A, 112-B and 112-C and determines, for example in vector space, deviations from the target power level for each respective phase. If the deviations are within acceptable defined tolerances, no adjustments are made. However, if the deviations are outside of the tolerances, then the power zone controller will generate adjustments to reduce the deviations.

The process 300 determines if there is a deviation of one or more monitored phase power levels from target phase power levels (306). If there is a deviation, then the process 300 adjusts the adjustable phase power supplies 122 to change the power level output by each adjustable phase power supply 122 (308). The power zone coordinator 110, for example, determines phase power supply 122 settings for the racks 120 and sums, in vector space, constituent calculated components to derive a solution set. The solution set, for example, is a collection of settings for the phase power supplies 122 in the racks 120 to reduce or otherwise minimize the detected deviation from the target power level for each respective phase.

For example, assume the zone coordinator 110 determines that the current on the phase A input must be decreased by 3.7%. Also assume that a solution space exists in which the currents on phase B can be increased up to 3%, and the current on phase C can be increased up to 2% and still be operating within acceptable tolerances. The power zone coordinator 110 generates settings for two or more racks 120 that collectively decrease the current on the phase A input by the required 3.7%, and increase the currents on phase B and C within their respective overheads of 3% and 2%. One example of determining settings on a per-rack basis is described with reference to FIG. 3 below.

After the adjustment, or if there is no appreciable deviation (e.g., the phase power levels are within acceptable tolerances), then the process 300 returns to monitor each phase in a multi-phase supply (302). Appropriate corrective adjustments are made again if the power levels drift or otherwise fall out of an acceptable tolerance.

Figure 4:
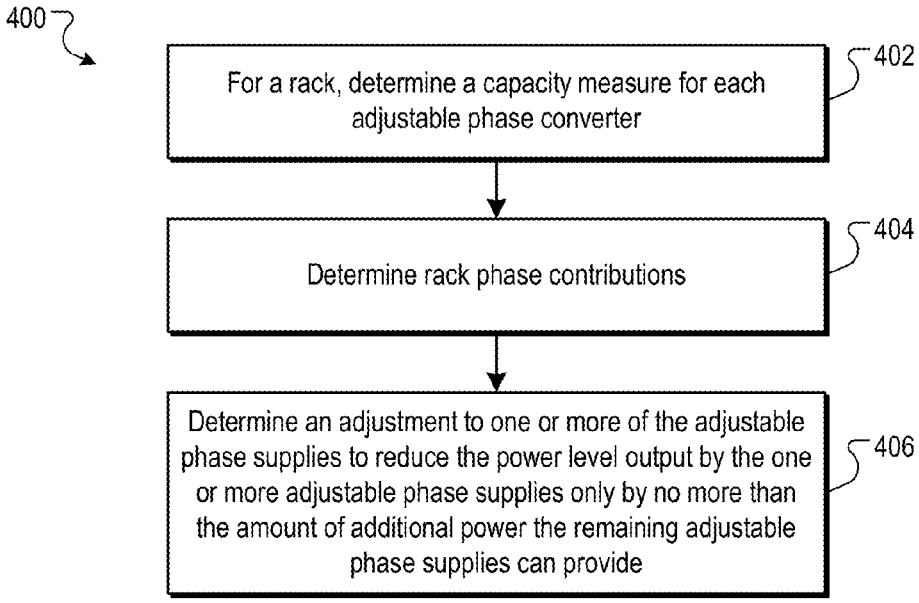
FIG. 4 is a flow diagram of an example process for determining phase power supply adjustments for a rack.

FIG. 4 is a flow diagram of an example process 400 for determining phase power supplies adjustments for a rack 120. The process 400 is implemented in a power zone coordinator of a power zone 102.

The process 400, for a rack 120, determines a capacity measure for each adjustable phase power supply 122 (402). For example, for a particular rack 120, the power zone coordinator 110 receives data from the rack 120 specifying the current settings of each rectifier. From the settings the power zone coordinator 110 determines for each rectifier capacity measure describing an amount of additional power, if any, the adjustable phase power supply 122 can provide to the direct current bus.

The process 400, for the rack 120, determines rack phase contributions (404). The rack phase contributions are the maximum contributions and constraints a rack 120 provides in deriving a solution. For example, once again assume the zone coordinator 110 determines that the current on the phase A input must be decreased by 3.7%, and the current on phase B can be increased up to 3%, and the current on phase C can be increased up to 2% and still be operating within acceptable tolerances. Thus, the coordinator 110 will process the settings of each rack 120 to determine if the current in phase A of the rack 120 can be decreased. To decrease a current in a particular phase power supply 122 of a rack 120, one constraint may be that at least one other phase power supply 122 in the rack 120 can provide the power that will be lost from the reduced current in the adjusted phase power supply 122. Thus, if a particular rack 120 has both adjustable supplies 122 for phase B and phase C providing maximum rated power, then the phase power supply for phase A in that rack 120 cannot have its current input decreased. Conversely, if another particular rack 120 has phase power supply B providing only 94% rated power, and phase power supply C providing maximum rated power, then the phase power supply for phase A in that rack 120 can have its current input decreased while the current for the phase power supply for phase B is increased. The phase power supply for phase A, however, can only be adjusted downward by no more than the amount of additional power the remaining adjustable phase power supplies in the rack 120 can provide.

The process 400 determine an adjustment to one or more of the adjustable phase power supplies 122 to reduce the power level output by the one or more adjustable phase power supplies 122 only by no more than the amount of additional power the remaining adjustable phase power supplies can provide (406). For example, the phase power supply 122 may be able to provide enough addition power by increasing its current such that the current limit for the phase power supply 122 of phase A is reduced by 3%.

The process 400 is done for each rack 120 in a manner that a solution set for the entire power zone is generated. After the solution set is generated, the power zone coordinator 110 provides the necessary adjustment signals to the racks 120 to implement the adjustments.

Although power zone coordinators 110 have been described on a per-zone basis, the power zone coordinators need not be physically implemented for each zone. Instead, a single power zone coordinator that logically manages each zone 102 can be used.

The target levels can be static (e.g., a balanced three phase load) or can be determined dynamically. For example, based on the power readings at the facility mains and the readings for each zone 102, a processes can determined adjustments for each zone periodically, e.g., every 30 seconds, for example.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on tangible computer storage medium for execution by, or to control the operation of, data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources. The term "data processing apparatus" encompasses all kinds of apparatus, devices, and machines for processing data, including by way of example a programmable processor, a computer, a system on a chip, or multiple ones, or combinations, of the foregoing. The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data. Devices suitable for storing computer program instructions and data include all forms of nonvolatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a computer having a display device for displaying information to the user and a keyboard and a pointing device, e.g., a mouse, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's user device in response to requests received from the web browser.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A system, comprising:

a data processing apparatus; and a computer storage apparatus including a computer readable medium encoded with instructions that when executed by data processing apparatus cause the data processing apparatus to perform operations comprising:

monitor, in a data center, a respective phase power level in each phase of an alternating current multi-phase supply that provides power to a plurality of data center alternating current devices, wherein:

at least a proper subset of the alternating current devices include alternating current devices that each receive as input each phase of the multi-phase supply, and, for each phase, includes an adjustable phase power supply that converts a respective alternating current input to a direct current output and provides the direct current output to a direct current bus that is common to each direct current output for each respective adjustable phase power supply in the alternating current device; and each of the alternating current devices in the proper subset is operable to receive from the data processing apparatus control signals that define an adjustable power setting for the respective adjustable phase power supplies and in response adjust the adjustable phase power supplies to change the power level output by each adjustable phase power supply;

compare the respective phase power levels to phase distribution criteria that describe a target phase power level for each respective phase and determine, based on the comparison, a deviation of one or more of monitored phase power levels from the respective one or more target phase power levels and in response:

determine, for each of two or more data center alternating current devices, an adjustment to one or more of the adjustable phase power supplies that adjusts the power level output by the adjustable phase power supply, wherein the combination of the adjustments of the power levels reduces the deviation of the one or more of monitored phase power levels from the respective one or more target phase power levels, and wherein determining an adjustment comprises:

determining, from the adjustable power setting for each adjustable phase power supply, a capacity measure for each adjustable phase power supply, the capacity measure describing an amount of additional power, if any, the adjustable phase power supply can provide to the direct current bus; and generating an adjustment to one or more of the adjustable phase power supplies to reduce the power level output by the one or more adjustable phase power supplies only by no more than the amount of additional power the remaining adjustable phase power supplies can provide as described by the capacity measure for each of the adjustable power supplies;

generate, for each of the two or more data center alternating current devices, respective control signals to adjust the one or more adjustable phase power supplies in the data center alternating current device according to the determined adjustment for the data center alternating current device; and provide, to each of the two or more data center alternating current devices, the respective control signals to the alternating current device.

2. The system of claim 1, wherein the phase distribution criteria describes a balanced phase power level for each respective phase.

3. The system of claim 1, wherein each alternating current device in the proper subset is a data center rack that includes a plurality of computer devices.

4. The system of claim 1, wherein the adjustable power settings for the respective adjustable phase power supplies define alternating current limit inputs to the adjustable phase power supplies.

5. The system of claim 1, wherein the adjustable power settings for the respective adjustable phase power supplies define alternating current limit inputs to the adjustable phase power supplies.

6. The system of claim 5, wherein each adjustable phase power supply is a single phase rectifier.

7. The system of claim 1, wherein:

the target phase power level for each respective phase is a dynamic phase power level; and the instructions cause the data processing apparatus to determine the phase distribution criteria that describe the target phase power level for each respective phase.

8. A computer implemented method, comprising:

monitoring, by a data processing apparatus, a respective phase power level in each phase of an alternating current multi-phase supply that provides power to a plurality of data center alternating current devices in a data center, wherein:

at least a proper subset of the alternating current devices include alternating current devices that each receive as input each phase of the multi-phase supply, and, for each phase, includes an adjustable phase power supply that converts a respective alternating current input to a direct current output and provides the direct current output to a direct current bus that is common to each direct current output for each respective adjustable phase power supply in the alternating current device; and each of the alternating current devices in the proper subset is operable to receive from the data processing apparatus control signals that define an adjustable power setting for the respective adjustable phase power supplies and in response adjust the adjustable phase power supplies to change the power level output by each adjustable phase power supply;

comparing, by the data processing apparatus, the respective phase power levels to phase distribution criteria that describe a target phase power level for each respective phase and determine, based on the comparison, a deviation of one or more of monitored phase power levels from the respective one or more target phase power levels and in response:

determining, by the data processing apparatus, for each of two or more data center alternating current devices, an adjustment to one or more of the adjustable phase power supplies that adjusts the power level output by the adjustable phase power supply, wherein the combination of the adjustments of the power levels reduces the deviation of the one or more of monitored phase power levels from the respective one or more target phase power levels, and wherein determining an adjustment comprises:

determining, from the adjustable power setting for each adjustable phase power supply, a capacity measure for each adjustable phase power supply, the capacity measure describing an amount of additional power, if any, the adjustable phase power supply can provide to the direct current bus; and generating an adjustment to one or more of the adjustable phase power supplies to reduce the power level output by the one or more adjustable phase power supplies only by no more than the amount of additional power the remaining adjustable phase power supplies can provide as described by the capacity measure for each of the adjustable power supplies;

generating, for each of the two or more data center alternating current devices, respective control signals to adjust the one or more adjustable phase power supplies in the data center alternating current device according to the determined adjustment for the data center alternating current device; and providing, to each of the two or more data center alternating current devices, the respective control signals to the alternating current device.

9. The method of claim 8, wherein the phase distribution criteria describes a balanced phase power level for each respective phase.

10. The method of claim 8, wherein each alternating current device in the proper subset is a data center rack that includes a plurality of computer devices.

11. The method of claim 8, wherein the adjustable power settings for the respective adjustable phase power supplies define alternating current limit inputs to the adjustable phase power supplies.

12. The method of claim 8, wherein the adjustable power settings for the respective adjustable phase power supplies define alternating current limit inputs to the adjustable phase power supplies.

13. The method of claim 8, wherein:

the target phase power level for each respective phase is a dynamic phase power level; and the instruction cause the data processing apparatus to determine the phase distribution criteria that describe the target phase power level for each respective phase.

14. A computer storage apparatus including a computer readable medium encoded with instructions that when executed by a data processing apparatus cause the data processing apparatus to perform operations comprising:

monitoring respective phase power level in each phase of an alternating current multi-phase supply that provides power to a plurality of data center alternating current devices in a data center, wherein:

at least a proper subset of the alternating current devices include alternating current devices that each receive as input each phase of the multi-phase supply, and, for each phase, includes an adjustable phase power supply that converts a respective alternating current input to a direct current output and provides the direct current output to a direct current bus that is common to each direct current output for each respective adjustable phase power supply in the alternating current device; and each of the alternating current devices in the proper subset is operable to receive from the data processing apparatus control signals that define an adjustable power setting for the respective adjustable phase power supplies and in response adjust the adjustable phase power supplies to change the power level output by each adjustable phase power supply;

comparing the respective phase power levels to phase distribution criteria that describe a target phase power level for each respective phase and determine, based on the comparison, a deviation of one or more of monitored phase power levels from the respective one or more target phase power levels and in response:

determining, for each of two or more data center alternating current devices, an adjustment to one or more of the adjustable phase power supplies that adjusts the power level output by the adjustable phase power supply, wherein the combination of the adjustments of the power levels reduces the deviation of the one or more of monitored phase power levels from the respective one or more target phase power levels, and wherein determining an adjustment comprises:

determining, from the adjustable power setting for each adjustable phase power supply, a capacity measure for each adjustable phase power supply, the capacity measure describing an amount of additional power, if any, the adjustable phase power supply can provide to the direct current bus; and generating an adjustment to one or more of the adjustable phase power supplies to reduce the power level output by the one or more adjustable phase power supplies only by no more than the amount of additional power the remaining adjustable phase power supplies can provide as described by the capacity measure for each of the adjustable power supplies;

generating, for each of the two or more data center alternating current devices, respective control signals to adjust the one or more adjustable phase power supplies in the data center alternating current device according to the determined adjustment for the data center alternating current device; and providing, to each of the two or more data center alternating current devices, the respective control signals to the alternating current device.

* * * * *